US006464043B2

(12) United States Patent
Wang

(10) Patent No.: US 6,464,043 B2
(45) Date of Patent: Oct. 15, 2002

(54) ELEVATOR EMERGENCY ESCAPE DEVICE

(76) Inventor: Jiun Jyh Wang, No. 50, Alley 97, Lane 354, San Her Rd., Feng Yuan, Taichung Hsien (TW)

( * ) Notice: Subject to any disclaimer, the term of this patent is extended or adjusted under 35 U.S.C. 154(b) by 0 days.

(21) Appl. No.: 09/803,529

(22) Filed: Mar. 8, 2001

(65) Prior Publication Data

US 2002/0125076 A1 Sep. 12, 2002

(51) Int. Cl.[7] ..... B66B 5/00; B66B 5/02
(52) U.S. Cl. ..... 187/314; 187/263
(58) Field of Search ..... 187/263, 314

(56) References Cited

U.S. PATENT DOCUMENTS 5,680,911 A * 10/1997 Wang ..... 187/263
5,878,845 A * 3/1999 Wang ..... 187/263 X
5,890,565 A * 4/1999 Wang ..... 187/263
5,906,252 A * 5/1999 Wang ..... 187/263

FOREIGN PATENT DOCUMENTS

JP 2270792 * 11/1990 ..... 187/263
JP 3133888 * 6/1991 ..... 187/263

* cited by examiner

*Primary Examiner*—Steven A. Bratlie
(74) *Attorney, Agent, or Firm*—Pro-Techtor International Services

(57) ABSTRACT

An elevator emergency escape device is activated by mechanical failure, power outage, an earthquake, fire, etc. When the device is triggered by a passenger breaking a cover over an emergency button and pressing the button, the device plays a voice message that informs all the passengers of the situation. The brake is released, and the elevator cab is aligned with the nearest floor, unless the situation dictates a predetermined floor at a different level. The elevator cab can be moved by backup electrical systems, or by manual operation. The device includes the voice message, a braille system for blind passengers, and a lifting device for handicapped persons.

5 Claims, 5 Drawing Sheets

FIG ,1
PRIOR ART

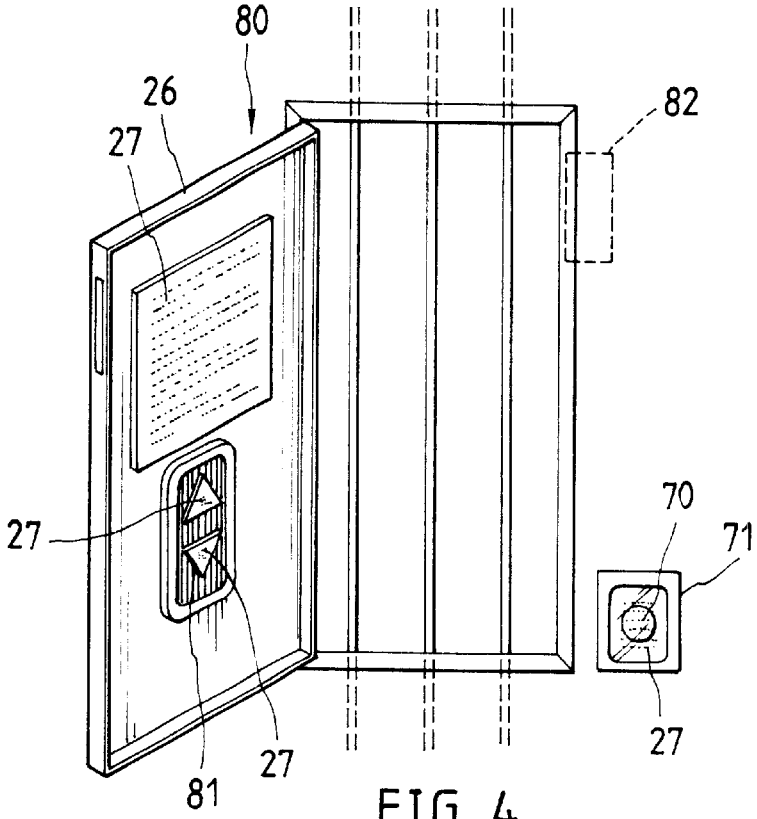
FIG, 4
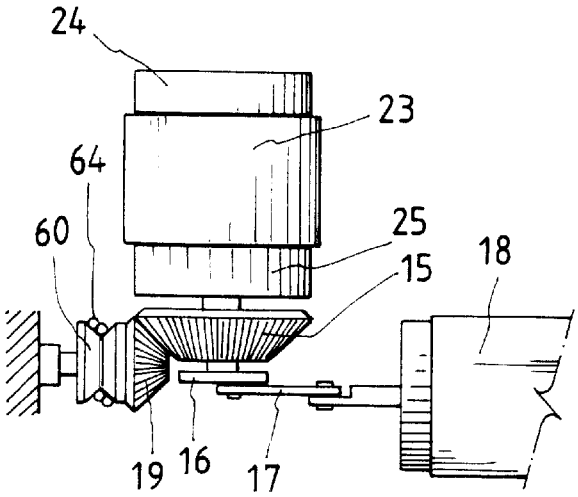
FIG, 6

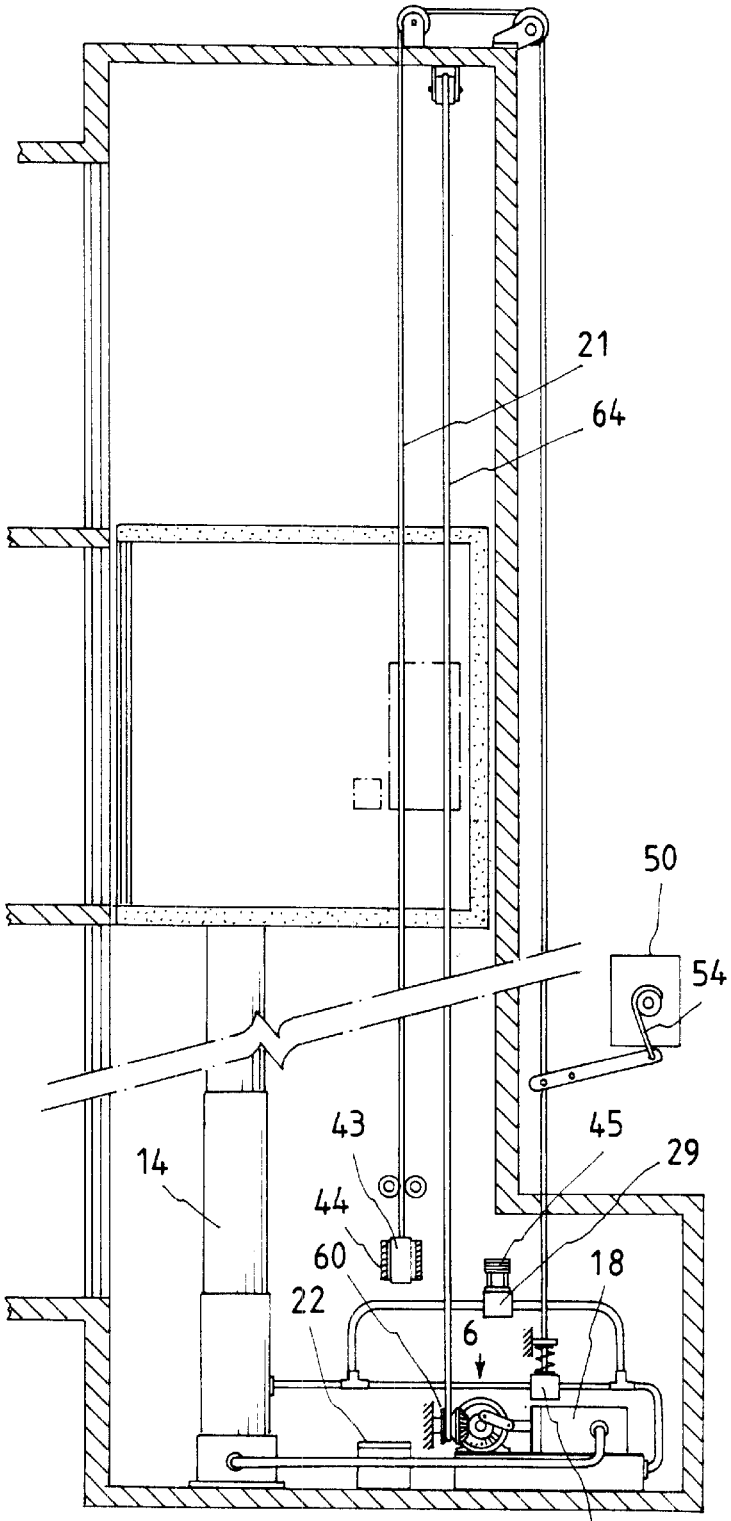
FIG, 5

ELEVATOR EMERGENCY ESCAPE DEVICE

BACKGROUND OF THE INVENTION

1. Field of the Invention

The present invention relates to an elevator emergency escape device. Particularly, when an elevator breaks down by a mechanical failure, a power outage, an earth quake, a fire in the building and so on, the elevator passengers are immediately informed by a voice device and a window is opened for grasping a manual operated cable. Then, these passengers can manually pull the cable to enable this elevator to arrive at a closest floor.

2. Description of the Prior Art

Referring to FIG. 1, it is a conventional elevator emergency escape device. In which, an action rod 2 is disposed on a brake 1. The brake 1 is mounted on a motor transmission shaft in a mechanical control room above the elevator. A pulling rod 3 is horizontally pivoted and one pivoted end of the pulling rod 3 contacts with the action rod 2. The other free end of the pulling rod 3 is rotatable within a range. A pulling cable 4 is connected with the free end. A middle portion of the pulling rod 3 is disposed with a rotary wheel 5 for an action cable 6 winding on. A transmission wheel 7 is positioned by one side of the rotary wheel 5. And, a supporting rod is positioned by the rotary wheel 5. The rotary wheel 5 drives the transmission wheel 7. With regard to the operation, a user pulls down the pulling cable 4 to make the pulling rod 3 move down. At this moment, the brake 1 is released from the motor transmission shaft. So, once the rotary wheel 5 is rotated, the transmission wheel 7 will drive an action wheel 8 to rotate accordingly. Then, the motor transmission shaft will be rotated, too. Therefore, the elevator cab is possible to move up or move down by manually pulling this pulling cable 4.

However, although the movement of the elevator cab can be manually operated by hand, it is still very inconvenient. All these operations are just based on feeling. It is not sure whether this elevator cab will precisely arrive at a safe floor or not. Even an additional battery and motor can be added in this system, it still has many related disadvantages on operation.

SUMMARY OF THE INVENTION

The primary objective of the present invention is to provide an elevator emergency escape device. When an elevator breaks down by a mechanical failure, a power outage, an earthquake, a fire in the building and so on, the elevator passengers are immediately informed by a voice message and a window is opened. Then, one of the passengers can manually pull the cables via the window to enable a back-up power supply source and to release the brake. Also, this elevator will arrive at a closest floor automatically.

The next objective of the present invention is to provide an elevator emergency escape device. When no power is supplied, the window is opened. So, the pulling cable can be reached through this window. By operating the pulling cable, this elevator cab can be moved up or down so as to arrive at a closest floor and then all the trapped elevator passengers can escape.

Another objective of the present invention is to provide an elevator emergency escape device. When the pulling cable is not working, an emergency button is disposed in the elevator cab. After breaking the protective cover of the emergency button, the emergency button can be pressed down to open the elevator door for escape.

A further objective of the present invention is to provide an elevator emergency escape device. In which, a voice device, braille and a handicap action element are provided in the elevator cab so that the handicap can escape, too.

Still another objective of the present invention is to provide an elevator emergency escape device. When an earthquake happens, the elevator will automatically stop, inform the elevator passengers by voice, and open the elevator door. Also, when the building is on fire, the elevator will automatically arrive at a safe floor that is preset as an emergency escape floor.

BRIEF DESCRIPTION OF THE DRAWINGS

FIG. 4 is a perspective view of the window portion of the first preferred embodiment of the present invention.

FIG. 5 shows a schematic view of the second preferred embodiment of the present invention.

FIG. 6 is an enlarged view from a selected portion in FIG. 5.

DETAILED DESCRIPTION OF THE PREFERRED EMBODIMENT

Figure 1:
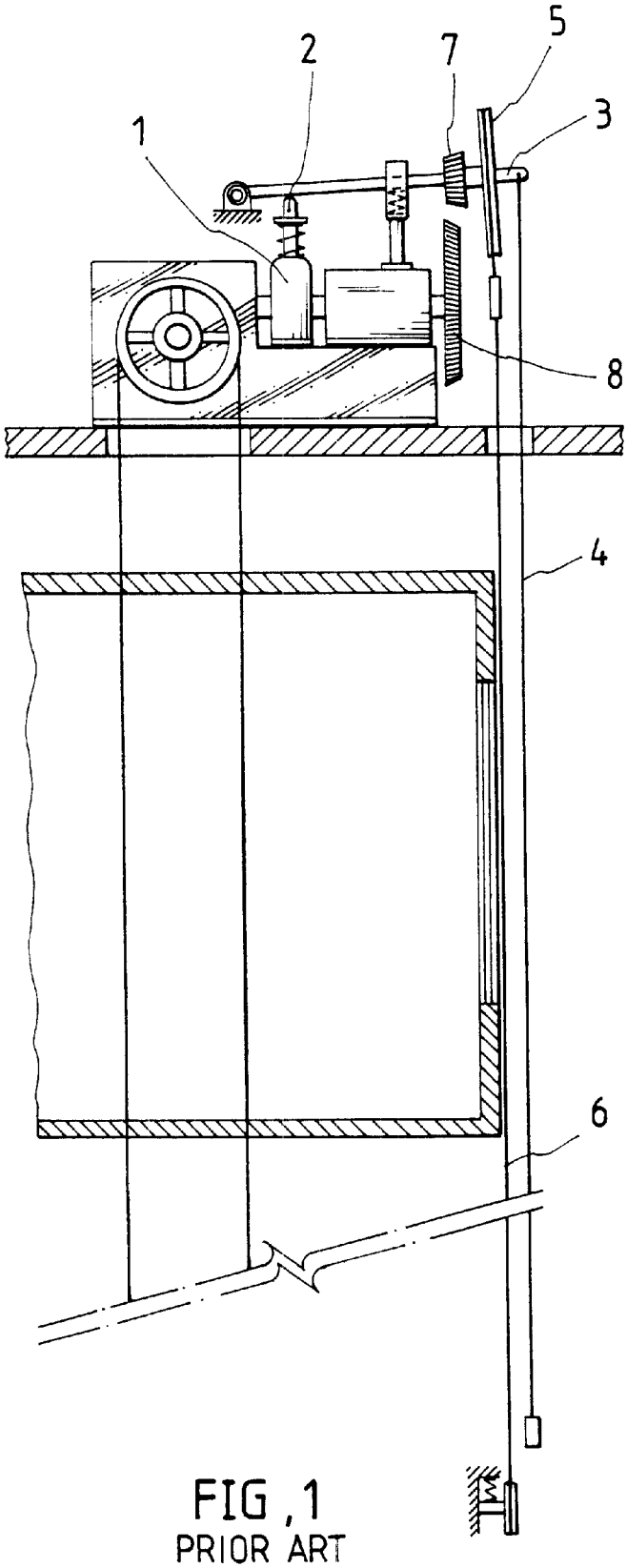
FIG. 1 shows a schematic view of a conventional elevator emergency escape device.
Figure 2:
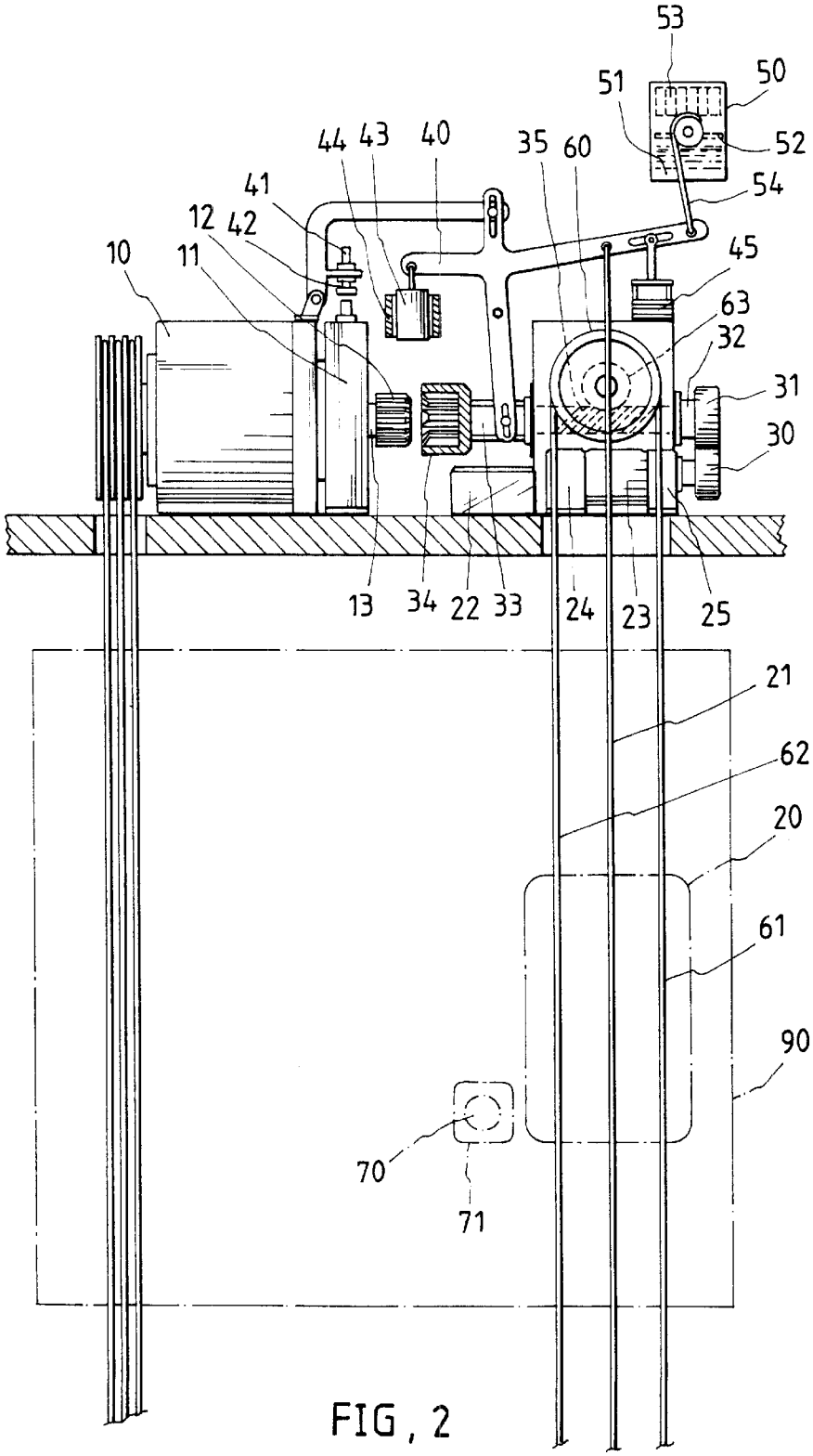
FIG. 2 shows a schematic view of the first preferred embodiment of the present invention.
Figure 3:
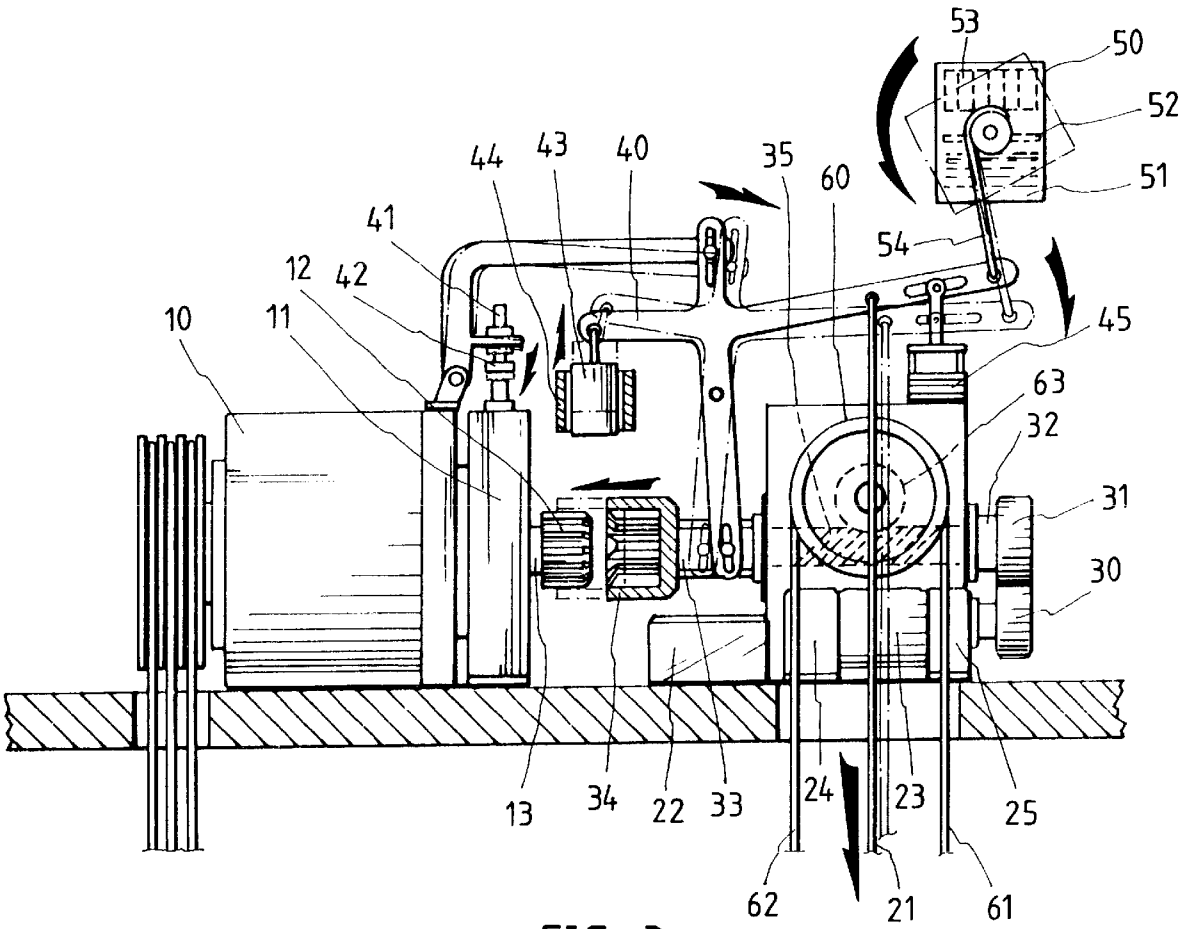
FIG. 3 shows a schematic view of the first preferred embodiment of the present invention illustrating the operation.

The present invention is to provide an elevator emergency escape device. It is to solve the related problems caused by an elevator's mechanical failure, a power outage, an earthquake, a fire in the building and so on, Referring to FIGS. 2 and 3, the first preferred embodiment of the present invention comprises the following portions or elements.

An elevator lifting motor 10 is to be used under a normal condition for driving the elevator cab up or down. And, a brake 11 is extended from one end of a shaft of the elevator lifting motor 10.

An emergency driving system is provided. A window 20 for emergency operation is disposed in the elevator cab and covered by a window cover 26. Under an emergency condition, a window controller 82 can be activated to open this window 20. Through the window 20, a controlling cable 21 as well as manual operated cables 61, 62 can be reached and grasped by hands.

A window 20 is disposed in an elevator cab. The window 20 is covered by a window cover 26 and the window cover 26 is controlled by a window controller 82 so that the window 20 can be opened under an emergency condition.

An emergency power supply device is sequentially composed of a building emergency power source, a back-up power source 22 in a mechanical control room and a second back-up power source 50 in the mechanical control room. When the emergency system is utilized on the elevator lifting motor 10, the back-up power source 22 is electrically connected to a driving motor 23 which has a cab alignment controller 24. The output from the driving motor 23 is tuned by a governor 25 so as to provide an optimal rotation speed. This output further transmits to a power shaft 32 via two gears 30, 31. An arm 40 is connected with a brake release rod 41 for releasing the brake 11. The brake release rod 41 can be micro-adjusted by an adjusting device 42 to maintain at a best position. The arm 40 also connects to a sliding shaft 33 that is movably fitted on the power shaft 32 and can transmit the rotation thereon. One end of the power shaft 32 is disposed with a clutch gear 34. Once the clutch gear 34 slides into a gear 12 of the elevator lifting motor 10, the output of the driving motor 23 can transmit to an axle 13 of the elevator lifting motor 10. The arm 40 also has a counterweight 43. An earthquake detection device 44 is set closely around two sides of the counterweight 43. On extended end of the arm 40 is connected with the controlling cable 21, an electromagnetic activator 45 and a second back-up power source 50. The controlling cable 21 can be manually operated by hand to make the arm 40 rotate a small angle. As a result, the electromagnetic activator 45 will be enabled.

The manual operated cables 61, 62 are wound on a cable disk 60. The manual operated cables 61, 62 can be pulled by hand via the window 20. The cable disk 60 is co-axially engaged with a bevel gear 63. The bevel gear 63 is geared with another bevel gear 35 disposed on the power shaft 32. Thus, when a user pulls the manual operated cables 61, 62 by hand, the pulling force will transmit to the axle 13 of the elevator lifting motor 10.

If none of the above elements is working, an emergency button 70 can be pressed down after breaking a protective cover 71. No matter the elevator cab is precisely aligned with the floor or not, the elevator door will be opened immediately. However, this is the last choice for escape. It is to ensure all the elevator passengers still can escape even under the worst condition.

A handicap device 80 as shown in FIG. 4 is set on the back of the window cover 26. It means that after opening the window cover 26, the handicap device 80 will show out. The voice message will pop out, too. In addition, braille is disposed on the window cover 26 for the blind. And, a lifting activator 81 is provided in the lower portion of the window cover 26 for the handicap.

A voice device and window controller 82 is able to provide a voice message and to open the window cover 26 automatically while this elevator is out of control.

The second back-up power source 50 contains a battery liquid 51, an anti-evaporation cover 52 and several electric plates 53. A hooking rope 54 is connected between the second back-up power source 50 and the arm 40. Once the arm 40 is rotated or swung, the arm 40 will pull the hooking rope 54 so that the second back-up power source 50 will rotate to a totally up-side-down position. Then, the battery liquid 51 contacts with (or mixes with) the electric plates 53 to create a certain reaction. Consequently, electricity is therefore generated for emergency use.

When the elevator breaks down by a mechanical failure, a power outage, an earth quake, a fire in the building or the like, an elevator passengers are informed by a voice message and then the elevator cab will be aligned with a closest floor by an emergency power source. When it is on fire, the elevator cab will automatically arrive at a preset emergency escape floor. This elevator cab can be moved by an electrical system or by a manual operation. The elevator cab further comprises a voice device for providing the voice message, braille for blind persons, and a lifting activator. And, an emergency button with a protective cover is disposed on the elevator cab so as to allow a passenger to break the protective cover to press down the emergency button so that the elevator cab's door will be aligned with a closest floor and then opened.

As shown in FIGS. 5 and 6, the second preferred embodiment of the present invention is just an example about a hydraulic powered elevator. That is the emergency driving system that is utilized on a hydraulic cylinder. It includes the following portions or elements.

It has a hydraulic cylinder 14 for lifting or lowering the elevator cab. A cab alignment controller 24 is set on the back of a driving motor 23. A governor 25 is disposed on the front end thereof. The axle of the driving motor 23 has a gear 15 and a rotary wheel 16. The rotary wheel 16 is connected with the crank 17 so that the hydraulic cylinder activator 18 will be enabled to make the hydraulic cylinder move up.

A manual operated cable 64 is disposed behind the window 20 so it can be pulled by hand to lift up the elevator cab. The manual operated cable 64 is wound on a cable disk 60. The cable disk 60 is co-axially engaged with two gears 19, 15. Once the manual operated cable 64 is pulled, it will enable the hydraulic cylinder activator 18 to provide a hydraulic media (such as a hydraulic liquid or oil) into the hydraulic cylinder 14 for lifting up the elevator cab.

A back-up power source 22 and a second back-up power source 50 are provided for emergency power supply. A hooking rope 54 is connected between the second back-up battery 50 and the controlling cable 21. The other end of the controlling cable 21 is first connected to a manual release valve 28 and then connected to a counterweight 43 and an earthquake detector 44. Also, another pressure release loop of the hydraulic cylinder 14 is disposed with an electromagnetic release valve 29 such that when the power is normally supplied, this electromagnetic release valve 29 can be used.

According to the above-mentioned emergency escape device, the emergency escape method is described as follows.

About the order of this elevator emergency escape power supply:

1. If the building emergency power system is available, this power source can be used as the first choice. If not, the back-up power source will provide the power needed. In case the back-up power source is not working, the second back-up power source will provide the power. Otherwise, the manual operation is the last option.

When the elevator breaks down by a mechanical failure or a power outage, the emergency escape procedure can be seen as follows.

1. The voice device sends out a voice message.
2. The window controller is enabled to open the window.
3. One of the trapped passengers can grasp the related cables to move the elevator cab to a closest floor. Then the elevator door will be aligned with the floor. For the handicap, this passenger can be informed by the voice message and by the braille so that the lifting activator can be enabled to let the elevator door align with the floor for emergency escape.
4. If the controlling cable also breaks down, the passenger still can pull the up or down manual operated cables so that the elevator cab can be moved to a closest floor for emergency escape.
5. If none of the above-mentioned system or method is working, one passenger can breaks the protective cover to press down the emergency button. Hence, the elevator will move to a closest floor for emergency escape.

When the elevator is out of order by an earthquake, the emergency escape procedures are as follows.

1. The voice device sends out a voice message.
2. This elevator cab will stop at a closest floor and open the elevator door.
3. After which, this elevator becomes the normal condition and can be used as usual.

When the elevator is out of order by a fire in the building, the emergency escape procedures are as follows.

1. The voice device sends out a voice message.
2. This elevator cab will stop at a closest floor and open the elevator door.
3. If the closest floor is not safe (such as on fire), this elevator cab can arrive at a safe floor by the manual operation (by hand). Once it arrives the preset safe emergency escape floor, the elevator door will open to allow these passengers to escape.

The above embodiments are only used to illustrate the present invention, not intended to limit the scope thereof. Many modifications of the above embodiments can be made without departing from the spirit of the present invention.

What is claimed is:

1. An elevator emergency escape device comprising:

an emergency power supply device comprising a building emergency power source, a first backup power source in a mechanical control room, and a second backup power source in said mechanical control room, an emergency driving system which is enabled by an actuating means cooperating with a power source to move an elevator up and down, a window disposed in an elevator cab, said window is covered by a window cover, said window cover is controlled by a windows controller so that said window can be opened during an emergency condition, an emergency button disposed in said elevator cab, said emergency button is covered by a protective plate, a manually operated device which is controlled by a manually operated cable and mates with a bevel gear for transmission, an earthquake detector disposed on a periphery of a counterweight; so that when said elevator is inoperable due to an emergency condition, a passenger opens said protective cover to press said emergency button, elevator passengers then being informed of the emergency condition by a voice message provided by a voice device, and said elevator cab is aligned with a closest floor by said emergency power supply; and when said emergency condition is a fire, said elevator cab is moved to a preset emergency escape floor, said elevator cab being moved by said emergency driving system or by manual operation; and wherein said elevator cab further comprises braille messaging means for blind persons, and a lifting activator for handicapped persons.

2. An elevator emergency escape device as defined in claim 1, wherein:

said emergency driving system is utilized on an elevator lifting motor, said emergency driving system comprising a driving motor with a cab alignment controller, an output from said driving motor being controlled by a governor to provide an optimal rotation speed, said output being transmitted to a power shaft via two gears, said emergency driving system further comprising an arm with a counterweight that provides a restoring force, said arm being connected to a brake release rod to release the brake, said arm also being connected to a sliding shaft which is movably fitted on said power shaft to transmit rotational force, one end of said power shaft being provided with a clutch gear; such that when said clutch gear slides into a gear of said elevator lifting motor, an output of said driving motor is transmitted to an axle of said elevator lifting motor.

3. An elevator emergency escape device as defined in claim 2, wherein:

said brake release rod is adjusted by an adjusting device to maintain said brake release rod at an optimal position.

4. An elevator emergency escape device as defined in claim 1, wherein:

said emergency driving system is utilized on a hydraulic cylinder, said emergency driving system comprising a hydraulic cylinder and a driving motor, a cab alignment controller being mounted on said driving motor, a governor being disposed on said driving motor, an axle of said driving motor having a gear and a rotary wheel, said rotary wheel being connected to a crank so that a hydraulic cylinder activator is enabled, a manually operated cable being disposed behind said window so that said manually operated cable can be pulled by hand to lift said elevator cab, said manually operated cable being wound on a cable disk, said cable disk being co-axially engaged with two gears; such that when said manually operated cable is pulled, said manually operated cable enables a hydraulic cylinder activator to transmit a hydraulic medium into said hydraulic cylinder to lift said elevator cab, a first end of said manually operated cable being connected to a manual release valve and a second end of said manually operated cable being connected to a counterweight and an earthquake detector.

5. An elevator emergency escape device as defined in claim 1, wherein:

said second backup power source contains a battery liquid, an anti-evaporation cover, and a plurality of electric plates, a hooking rope being deployed so as to rotate said second backup battery to an upside down position such that said battery liquid contacts said electric plates to create a reaction that generates electricity for emergency use.

* * * * *